United States Patent [19]

Nakamura

[11] 4,228,111

[45] Oct. 14, 1980

[54] VARIABLE VENTURI TYPE CARBURATOR

[75] Inventor: Norihiko Nakamura, Shizuoka, Japan

[73] Assignee: Toyoto Jidosha Kogyo Kabushiki Kaisha, Aichi, Japan

[21] Appl. No.: 41,188

[22] Filed: May 21, 1979

[30] Foreign Application Priority Data

Aug. 4, 1978 [JP] Japan ..... 53-94534
Nov. 29, 1978 [JP] Japan ..... 53-163177[U]

[51] Int. Cl.[2] ..... F02M 9/06
[52] U.S. Cl. ..... 261/44 C
[58] Field of Search ..... 261/44 C

[56] References Cited

U.S. PATENT DOCUMENTS

| | | | |
|---|---|---|---|
| 1,822,712 | 9/1931 | Skinner | 261/44 C |
| 3,424,441 | 1/1969 | Caisley | 261/44 C |
| 3,493,217 | 2/1970 | Farley | 261/44 C |

FOREIGN PATENT DOCUMENTS

| | | | |
|---|---|---|---|
| 510753 | 8/1939 | United Kingdom | 261/44 C |

*Primary Examiner*—Tim R. Miles
*Attorney, Agent, or Firm*—Browdy and Neimark

[57] ABSTRACT

A variable venturi type carburetor having a suction chamber disposed upstream from the throttle valve, a suction piston having an increased diameter portion in sliding contact with the suction chamber and movable back and forth in the suction chamber, a piston rod of the suction piston being in sliding contact with a guide rod of the suction chamber, and a compression spring interposed between the suction chamber and the suction piston. In this carburetor, the space between the guide rod and the piston rod is filled with air rather than damper oil. Additionally, the outer peripheral surface of a flange formed at the end of the guide rod and the inner peripheral surface of the suction piston cooperate with each other in defining therebetween a pressure transmission delaying clearance means through which a gas damper chamber defined in the suction piston is communicated with a vacuum chamber defined in the suction chamber at the opposite side of the flange to the damper chamber.

10 Claims, 6 Drawing Figures

VARIABLE VENTURI TYPE CARBURATOR

FIELD OF THE INVENTION

The present invention relates to a variable venturi type carburator.

BACKGROUND OF THE INVENTION

As well known to those skilled in the art, the carburators of the engines of automobiles are broadly classified by the type of venturi. There are fixed venturi type carburators and variable venturi type carburators such as SU carburator. Both of these types of carburators have their own advantages and disadvantages, and have been used depending on the performance desired.

Recently, regulations have been issued to limit the noxious exhaust emissions such as CO, HC, $NO_2$ and so forth from automobile engines, in order to prevent environmental pollution.

Conversely, there is an increasing demand for carburators which can cope with the requirements for improved fuel consumption and safety.

The variable venturi type carburator such as SU type carburator has no shunting of main and slow fuel systems nor any connection system and, accordingly, has good transient response characteristics of the fuel supply to the change of flow rate of air-fuel mixture due to the opening and closing of the throttle valve. Therefore, the variable venturi type carburator is preferred for the exhaust emission control, as well as for improvement in fuel consumption and driveability. For this reason, it is becoming popular to install the variable venturi type carburator, which has heretofore been used only in automobiles designed for sport use or the like, on conventional automobiles. These variable venturi carburetors have, despite their mentioned advantages, problems. This invention is directed to the solutions of those problems.

In order to illustrate the problems of the conventional variable venturi type carburetor, reference is made to FIG. 1 which shows a typical conventional varibale venturi carburetor of the inclined type. Referring to FIG. 1, a conventional variable venturi carburetor is shown having a choke valve 1 which is disposed in an air horn 2 which is connected through a casing 6 to the bore 5 of a mixing chamber 4 having a throttle valve 3. The casing 6 has a piston guide 7 slideably receiving the reduced-diameter portion of a suction piston 8, while the increased-diameter portion of the suction piston 8 is adapted to slide in a suction chamber 9 provided in the casing 6. A piston rod 10 press-fitted to the suction piston 8 and centered on the latter makes a sliding contact with the guide rod 11 of the suction chamber 9 to thereby vary the cross-sectional area of the venturisection 12 in the bore 5.

A metering rod apparatus is connected to the piston 8 to move therewith to admit fuel from reservoir into venturi section 12 when throttle valve 3 is opened. The carburetor shown has the usual features such as a low speed idle jet and fuel metering valve.

Basically, the displacement or stroke of the suction piston 8 is determined by the vacuum generated at the venturi section 12 and the force of a compression spring 13 interposed between the inner end of the suction piston 8 and the inner other end of the suction chamber 9.

It is often the case that the suction piston 8 is caused to move back and forth in an oscillating manner, due to a pulsation of the intake vacuum during the low speed running of the engine, resulting in the undesirable vibration or pulsing of the suction piston 8.

Another problem occurs when the throttle valve 3 is opened abruptly causing the suction piston 8 to move in an impacting manner, resulting also in an undesirable vibration or an overshoot.

These undesirable vibrations and overshoots of the suction piston 8 in turn cause various problems such as an excessive leaning of the mixture, thus hindering the smooth operation of the engine and the performance of the vehicle.

One solution used to avoid these problems has been to fill the suction piston rod 10 with damper oil 14 which prevents the vibration of the suction piston 8 by the damping effect provided by the damper oil 14 as piston rod 10 slides within guide 11.

The oil is kept within hollow portion of rod 10 by a seal which is affixed by a rod and a plug to the casing 6. Thus, the oil acts as a compression spring.

The damper oil 14, however, leaks out and is depleted as time elapses. In order for this arrangement to function efficiently, it is necessary to replenish the oil periodically.

Just when to replenish the oil is unknown since the rate of depletion will vary depending on how and when the vehicle is driven and the overall dependability of the carburetor.

In addition, it is necessary that the viscosity of the damper oil 14 remain constant in order that the latter may perform the required damping function. If the damping oil 14 is too viscous, the speed of movement of the suction piston 8 is lowered to inhibit the response characteristic thereby making the air-fuel mixture excessively rich which in turn increases the noxious exhaust emissions and rate of fuel consumption. To the contrary the required damping effect cannot be obtained if the viscosity is too low which may cause the carburetor to provide an inadequate supply of fuel to the engine.

Further, the viscosity of the damper oil 14 changes depending on the temperature. Consequently, smooth engine operation is often impossible after a cold start, and during continous running at a high temperature for long durations. I.e., the carburetor which has been set for optimum operation in the cold winter season cannot operate adequately in the hot summer season.

Thus, the conventional varibale venturi type carburetor utilizing damper oil requires extremely maintenance and even if it is performed is too sensitive to temperature variances which normally occur within the year or within a given season of the year.

Various types of carburetors having improved oil dampers have been proposed as, for example, in Japanese Patent Laid-Open Publication No. 1724/1978, as a solution to the problems of oil damped carburetors.

Also, a mechanism has been proposed in which, as illustrated in FIG. 1 a suction hole 15 is provided in the suction piston 8, so as to impart a delay or time lag to the working of damper oil 14. This type of mechanism, however, is inefficient in that the clearance provided in the sliding fit between the guide rod 11 and the small diameter portion of the suction piston 8 is too small so that no breaking effect which would assist the damper oil is effected.

Various variable venturi type carburetors having no oil damper have also been proposed. These carburetors, however, have an extremely complicated construction and require troublesome maintenance and, therefore, are not suitable for practical use because of their high cost of production and maintenance.

SUMMARY OF THE INVENTION

It is therefore a major object of the invention to provide a variable venturi type carburetor in which the movement of the suction piston in the transient state can be accurately controlled and predicted thereby insuring the most efficient operation of the variable venturi type carburetor.

It is another object of the invention to provide a variable venturi type carburetor the construction of which is simplified through the elimination of damper oil thereby eliminating oil replenishment maintenance and temperature induced variations in performance.

It is a further object of this invention to provide an improved variable venturi carburetor whereby the desired performance characteristics can be effected by a simple and inexpensive mechanical design.

A still further object of this invention is to provide an improved variable venturi carburetor whereby the desired performance characteristics can be predictably changed as desired by the inexpensive mechanical substitution of one removable portion for another.

An additional object of this invention is the provision of a variable venturi carburetor having a suction chamber and a damper chamber in communication therewith, the rate of communication as to pressure being predetermined and constant.

These and other objects, as well as advantageous features of the invention will become more clear from the following description of the preferred embodiments taken in conjunction with the accompanying drawings.

DESCRIPTION OF THE PREFERRED EMBODIMENTS

In order to achieve the above stated objects of the invention, there is provided a variable venturi type carburetor having the features described hereinunder.

In the variable venturi type carburetor of the invention, the vacuum in the vacuum chamber of the suction chamber is changed without delay in response to the change in the venturi vacuum caused by movement or opening of the throttle valve. This vacuum is transmitted to the damper chamber in the suction piston through a pressure transmission delaying means such as that constituted by a small clearance between the flange of the guide rod and the suction piston so that the pressure in the damper chamber is changed over a certain time lag in relation to the change of vacuum at the venturi. Consequently, the suction piston is caused to move in such a manner that the force exerted by the pressure in the damper chamber, the force exerted by a compression spring and the force exerted by the venturi vacuum are balanced. The mechanical design to achieve this result is derived from the difference between the area of the outer end of the suction piston and the area of the inner or rear end of the increased diameter portion of the same suction piston. This enables the suction piston to respond to various throttle operations such as abrupt opening immediately after the change of venturi vacuum, slight opening after idling, slight opening after abrupt closing and so forth. The carburetor of the invention is therefore free from undesirable vibrations and overshoot of the suction piston without the necessity of the oil damper which would require troublesome maintenance.

Consequently, the response characteristic is remarkably stable and predictable producing a responsive and efficient variable venturi type carburetor.

The specific embodiments of the invention will be more fully described with reference to the accompanying drawings.

Figure 2:
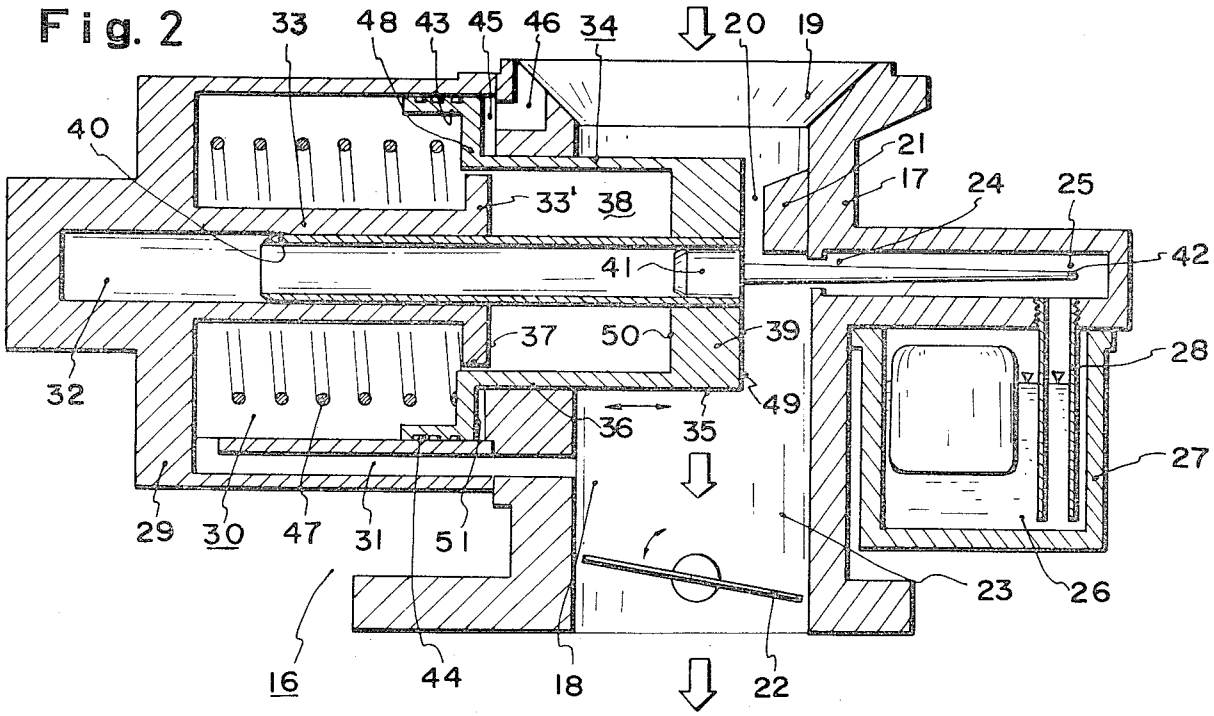
FIG. 2 is a side sectional view of an embodiment of the invention.
Figure 3:
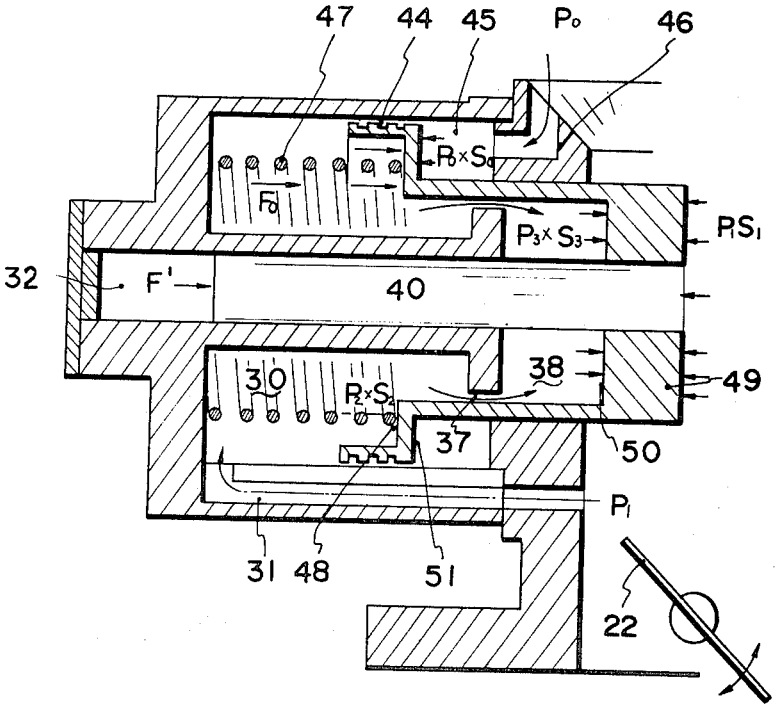
FIG. 3 is a partial enlarged sectional view illustrating the suction piston and the pressures thereon.

Referring first to FIGS. 2 and 3 showing a first embodiment of the invention, a variable venturi type carburetor embodying the present invention is generally designated by numerical 16. The casing of the carburetor 16 is denoted by numerical 17. An air horn 19 is formed at the upper portion of bore 18 of the casing 17 while intermediate venturi portion 20 has a fixed venturi member 21. The downstream side portion of the bore 18 down to the throttle valve 22 constitutes a mixing chamber 23. A needle aperture 24 is formed in the casing and receives a metering jet needle 42 which alternately opens and closes communication between venturi portion 20 and a chamber 25. A float bowl 27 includes a float chamber 26 and a suction tube 28 communicationg with the chamber 25.

A suction chamber 29 is attached in an airtight manner to the opposite side of the casing 17 from the float bowl 27 by suitable attachment means. The suction chamber 29 has a vacuum chamber 30 which is in communication with the mixing chamber 23 of bore 18 by means of a vacuum passage 31 of a predetermined diameter.

A guide rod 33 having an inner bore 32 is provided at approximately the center of the suction chamber 29 and extends therethrough. The end of the guide rod 33 flares outwardly to form a flange 33'.

A suction piston 34 has a front reduced diameter portion 35 which makes an airtight sliding contact with a guide portion 36 of casing 17.

A clearance 37 as small as possible to allow essentially frictionless contact and to permit pressure release is formed between the circumferential inner rear surface of the suction piston 34 and the annular outer end of the flange 33' of the guide rod 33. This configuration functions as a pressure transmission delaying means. A gas damper chamber 38 is provided between the flange 33' and the inner end surface of the reduced diameter portion 35 of the suction piston 34.

A hollow piston rod 40 is press-fitted in an aperture of the end 39 of the reduced diameter portion 35 of the suction piston 34 and is received slidably in an airtight manner by the hollow bore 32 of guide rod 33.

A head portion 41 is press-fitted in the end of the piston rod 40. Needle 42 extends from head 41 through the venturi portion 20, aperture 24 and into chamber 25.

Aperture 24 constitutes a metering jet and needle 42 is centered in said aperture so as to decrease or increase communication between chamber 25 and venturi portion 20 as suction piston 34 moves.

A reference numeral 43 denotes an increased diameter portion of the suction piston 34, which makes an airtight and slidable contact with the inner peripheral surface of suction chamber 29, through a seal 44 which is formed of annular grooves or the like.

An atmospheric chamber 45 is formed between the increased diameter portion 43 and the casing 17 and communicates with air horn 19 by means of air vent 46.

A compression spring 47 is disposed in the vacuum chamber 30 so as to act between the inner rear surface of the suction chamber 29 and the rear surface 48 of increased diameter portion 43 of suction piston 34.

Reference numerals 49 and 50 denote respectively, the front and rear surfaces of reduced diameter portion 35 of the end 39 of the suction piston 34, while numeral 51 denotes the front surface of the increased diameter portion 43 of the suction piston 34.

The air confined in the hollow bore 32 of the guide rod 33 by piston rod 40 is sealed uniformly in an airtight manner against the external system. The air therein acts as a damper and has the same kind of elasticity as the compression spring 47.

The operation of the carburetor having the described construction in the transient period between the slow speed operation as shown in FIG. 2 and an acceleration with increased throttle valve opening 22 as shown in FIG. 3 will now be described.

For the sake of discussion, the areas of front and rear pressure receiving surfaces 49, 50 of the end portion 39 of the suction piston 34 are denoted by S1, S3, while the pressures action on these surfaces are represented by P1, P3. Similarly, the areas of the front pressure receiving surface 51 and the rear pressure receiving surface of the increased diameter portion 43 are represented by S0 and S2, while pressures acting on these surfaces are represented by P0 and P2.

Also the force of the compression spring 47 is represented by F0 and the elastic force of the gas or air in the hollow bore 32 of guide rod 33 is represented by F'. Since both forces are proportional to the stroke process of suction piston 34, the following relationship exists:

$$, F'+Fo=F$$

Assuming an equilibrium state of the suction piston 34 under a certain intake air flow rate, the following equation (1) exists:

$$PoSo+P1S1=P2S2+P3S3+F \quad (1)$$

In the equilibrium state, the pressure in the mixing chamber 23 is equalized with the pressure in the vacuum chamber 30 through vacuum passage 31. At the same time, this pressure is transmitted to the gas damping chamber 38, through the clearance 37. Thus the following equation (2) is satisfied:

$$P1=P2=P3 \quad (2)$$

From equations (1) and (2) the balancing pressure is derived as follows:

$$P1=P2=P3=(PoSo-F)/(S2+S3-S1) \quad (3)$$

Thus, the balancing pressure is determined by the shape and size of the suction piston 34, atmospheric pressure Po, force Fo of the compression spring 47 and the pressure F' of the gas in the bore 32.

As throttle valve 22 is abruptly opened from the above equilibrium state so as to quickly accelerate the engine, the pressure at the venturi portion is changed by ΔP due to the increment of the intake air flow rate. I.e. the pressure is changed from P1 down to P1−$\tilde{\Delta}$P.

Since the suction piston 34 functions or moves to balance the pressures so as to maintain the balancing pressure as given by the equation (3), it naturally moves to negate the change ΔP of the pressure.

Thus in this case, the suction 34 is moved to change the pressure at the venturi portion 20 from (P1−ΔP) back to P1.

This movement of the suction piston is effected instantaneously and simultaneously with the pressure change ΔP, and the resulting impulse is transmitted through the venturi portion 20, mixing chamber 23 and the vacuum passage 31 of large diameter to the vacuum chamber 30, without delay so as to also cause a pressure change ΔP in the latter.

Consequently, the following equation (4) is established:

$$P2=P1-\Delta P \quad (4)$$

The pressure change in the vacuum chamber 30 does not materially affect the atmospheric chamber 45 due to the presence of seal 44, so that the pressure Po is not changed. However, since the gas damper chamber 38 is in communication with the vacuum chamber 30 through clearance 37 which functions as a pressure transmission delaying passage, the pressure change in the vacuum chamber 30 acts to change the pressure P3 in the gas damper chamber 38. Since the clearance is extremely small, however, the pressure transmission is delayed considerably. Thus, the pressure P3 is not changed immediately. Thus at an instant immediately after the abrupt opening of the throttle valve 22, i.e. at the instant immediately after the generation of the pressure change ΔP, the pressure P3 in the gas damper chamber 38 is maintained at the same level as that just before the opening of this valve., so as to satisfy the following equation:

$$P3=P1 \quad (5)$$

Thus, at an instant immediately after the abrupt opening of the throttle valve 22, the following forces act on the suction piston 34.

Namely, the leftward (as viewed in FIGS. 2 and 3) opening force f1 on the suction piston 34 is given by the following equation (6):

$$f1=Poso+(P1-\Delta P)I \quad (6)$$

At the same time, the righward (as viewed in FIGS. 2 and 3) closing force f2 is given by the following equation (7):

$$f2=P2S2+P3S3+F=(P1-\Delta P)S2+P1S3+F \quad (7)$$

Therefore, the leftward force Δf which acts to open the suction piston 34 is derived from the equations (3), (6) and (7) as follows:

$$\Delta f = f1 - f2 + PoSo - F - P1(S2 = S3 - S1) + \Delta P(S2 - S1) = \Delta P(S2 - S1) \quad (8)$$

Thus, the force Δf for opening the suction valve 34 is given as a product of the pressure change generated at the venturi portion 20 and the difference between the area of the rear surface 48 of the increased diameter portion 43 of the suction piston 34, i.e. the area of the movable surface in the vacuum chamber 30, and the area of the front surface 49 of the reduced diameter portion 35.

Since these areas S1 and S2 are constants which can be predetermined in the design, the suction piston 34 can be made to respond to the abrupt opening of the throttle valve 22 in three ways.

(1) When S2 is greater than S1 (S2>S1). The suction piston 34 commences to open leftward immediately after the pressure change ΔP, at a force proportional to the pressure change ΔP. The response speed is in proportion to the difference of areas S2−S1.

(2) When S2 is equal to S1 (S2=S1).

In this case, needless to say, the force acting on the suction piston 34 is zero. Therefore, the suction piston 34 does not open the venturi portion at all in the period immediately after the opening of the throttle valve. Rather, the suction piston moves gradually to increase the opening of the venturi at a small rate as the pressure P3 in the gas damper chamber 38 decreases below the pressure P1 as a result of the communication of the vacuum chamber 30 with the gas damper chamber 38 through the clearance 37.

Consequently, the response speed of the suction piston becomes smaller as the clearance 37 gets smaller. Conversely, the greater the clearance 37, the larger the response speed becomes. Consequently, it is possible to suitably prevent the overshoot attributable to the damper effect by initial design.

Figure 1:
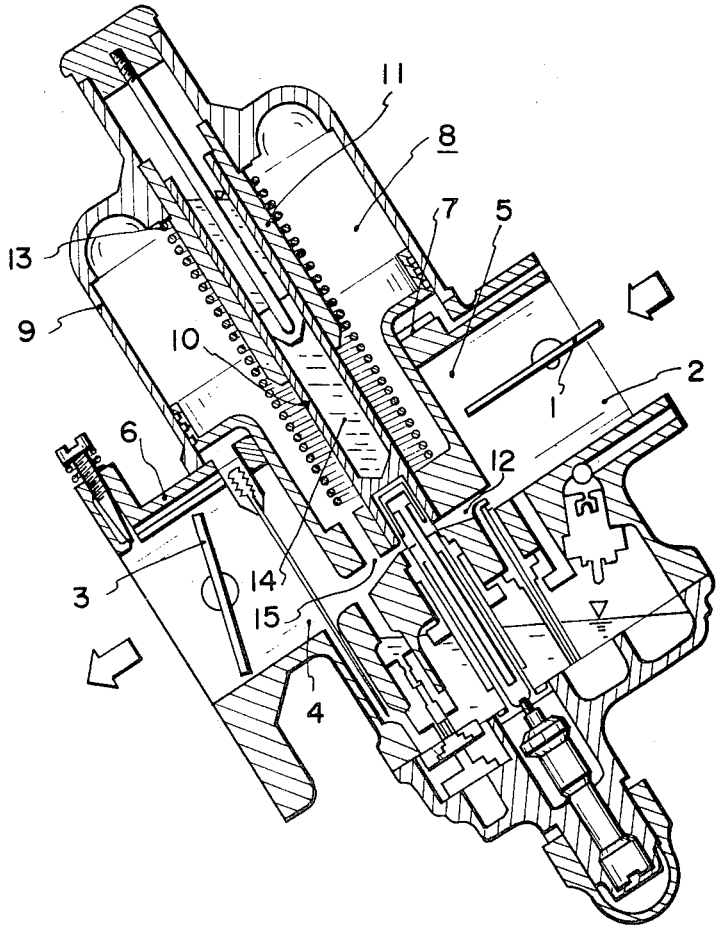
FIG. 1 is a sectional view showing a typical conventional variable venturi type carburetor.

In the conventional arrangement as shown in FIG. 1, a suction hole 15, is provided in addition to the braking effect of the oil damper in response to the impacting opening force. In this case, however, the clearance between the neck portion of the suction piston 8 and the shoulder portion of the guide rod 11 is too large to provide a suitable response delay. Therefore, it is impossible to obtain a sufficient braking effect so that an overshoot is effected when Δf equals to ΔPS2.

(3) When S2 is smaller than S1 (S2<S1).

In this case, a negative force is applied to the suction piston 34 so that the suction piston 34 is at once moved to close the venturi simultaneously with the abrupt opening of the throttle valve 22. The suction piston is then moved in the opening direction as the pressure P3 decreases below the pressure P1 as a result of the transmission of pressure from the vacuum chamber 30 to the gas damper chamber 38 through the clearance 37.

As stated above, it is possible to obtain the desired response characteristic of the suction piston 34 by suitably selecting the force which acts on it in instantaneous response to the abrupt opening of the throttle valve 22 by designing the suction piston 34 to have the desired areas S1, S2.

For instance, it is possible to obtain a transient response characteristic to ensure a fuel efficient acceleration of the engine by selecting a large value (S2−S1) within such a range as not to cause the overshoot and undesired vibration of the suction piston 34 in accordance with the aforementioned case (1).

To the contrary, if it is desired to enrich the mixture during the acceleration, the area S2 is selected to be smaller than S1, in accordance with the aforementioned case (3), so that the suction piston 34 is temporarily moved in the closing direction.

Figure 4:
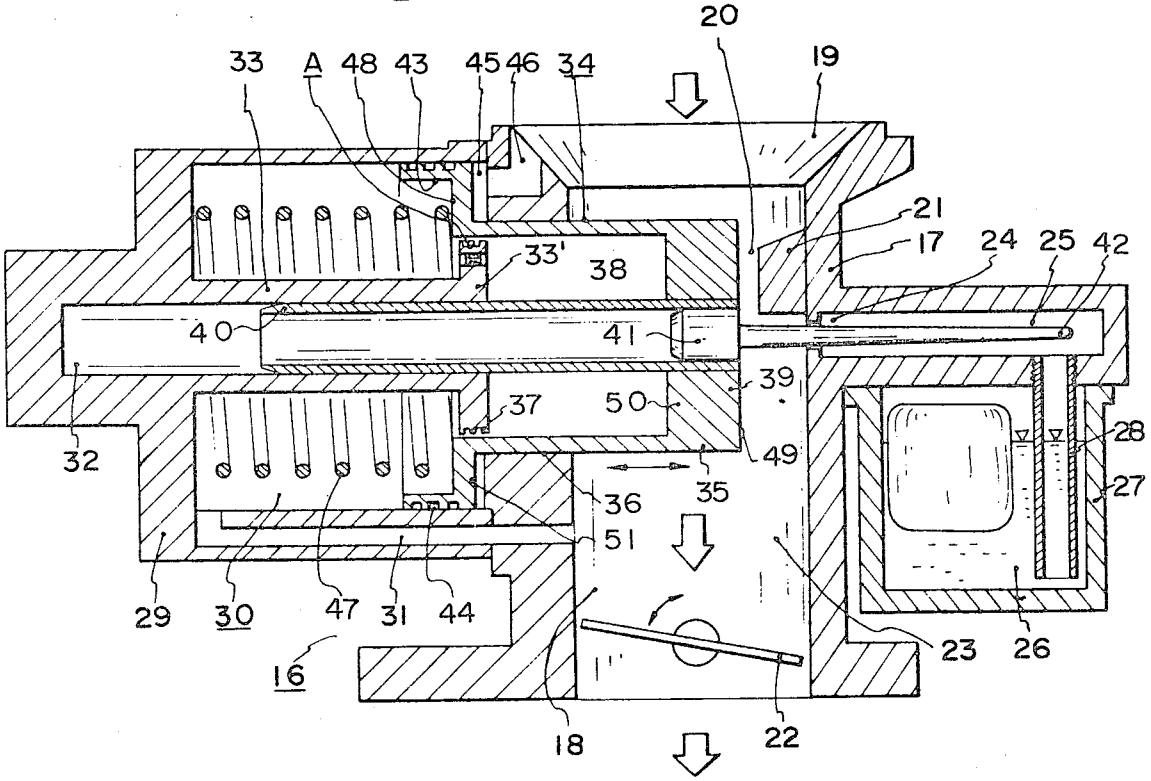
FIG. 4 is a side sectional view of another embodiment in which a pressure transmission delaying passage is constituted by an orifice member.
Figure 5:
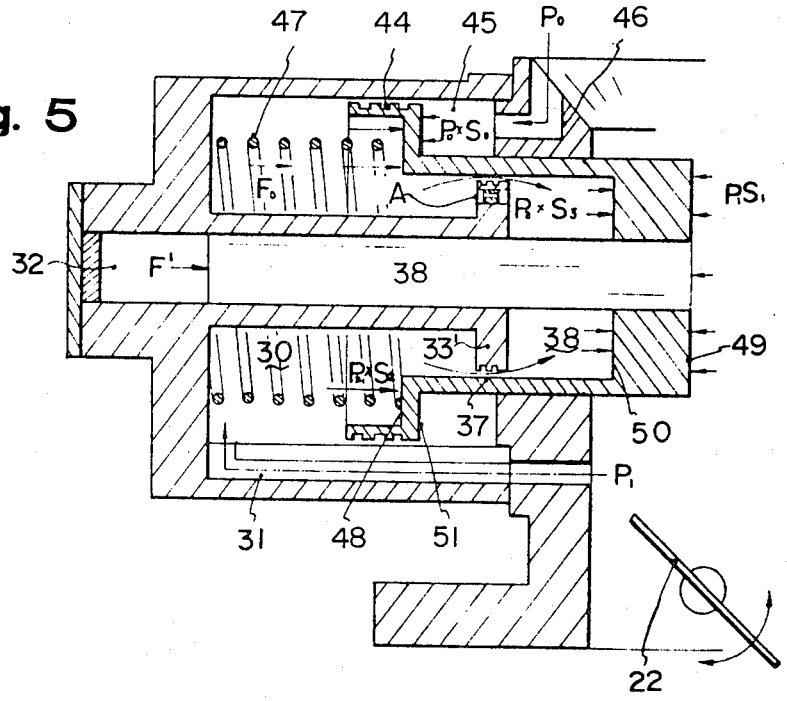
FIG. 5 is an enlarged sectional view showing specifically the suction chamber, damper chamber, suction piston and the interrelationships therebetween
Figure 6:
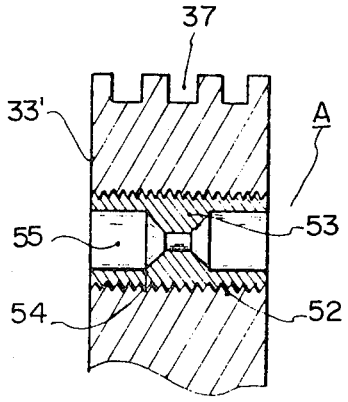
FIG. 6 is an enlarged franmentary sectional view of the flange of the suction piston showing the orifice member in detail.

FIGS. 4, 5 and 6 show a second embodiment of the invention. This embodiment is constructed basically in the similar manner as the first embodiment as shown in FIGS. 2 and 3 and operates substantially in the same manner as the latter. Thus, the parts and members denoted by the same reference numerals are substantially the same as those of the first embodiment. Therefore, the description of this embodiment is focussed mainly on the points by which this embodiment is differentiated from the first embodiment.

In the second embodiment, the flange 33' at the end of the guide rod 33 has a configuration such as annular grooves formed on its outer annular surface so that it may constitute, in cooperation with the inner peripheral surface of the suction piston 34, a small clearance allowing some passage of air therethrough. At the same time, the flange 33' is provided with an orifice A which constitutes a pressure transmission delaying passage or means.

Referring to FIG. 6, an orifice body 53 is threaded as at 54 and received by threaded bore 52. The gas damper chamber 38 is adapted to communicte with the vacuum chamber 30 through the pressure transmission delaying passage 55 in orifice body 53.

The orifice body 53 can be renewed as desired, at the time of overhauling or adjustment of the carburetor. Orifice bodies allowing for different rates of pressure transmission can be interchangably placed in the carburetor.

In this embodiment, the pressure transmission delaying passage 55 of the orifice body 53 performs the the same function as the annular clearance formed around the flange 33' of the embodiment as shown in FIGS. 2 and 3. Namely, this passage allows the mutual communication of the damper chamber 38 and the vacuum chamber 30 with each other so as to equalize the pressures in these chambers to the state of equilibrium. This passage 55 also serves to transmit the vacuum introduced into the vacuum chamber 30 from the vacuum passage 31, to the gas damper chamber 38 with a certain time lag which depends on the size of passage 55.

As explained with reference to FIGS. 2 and 3 the leftward force for moving the suction piston 34 in the opening direction is given by the equation Δf=ΔP(S2−S1). Thus, the force for opening the venturi is given as the product of the pressure change at the venturi portion 20 and the difference in area between the rear surface 50 and the front surface 49 of the reduced diameter portion 35 of the suction piston 34, as is the case in the first embodiment, however, in this embodiment, the velosity of the movement of the suction piston 34 as a result of the balancing of the pressure P1 in the vacuum chamber 30 and the pressure P3 in the gas damper chamber 38, after the movement of the suction piston 34 by the force Δf, can optionally be changed by selecting the size of the orifice A. This advantage is not possible in the embodiment as shown in FIGS. 2 and 3. Because of this feature, it is possible to accurately set the damper effect, so as to effectively avoid the overshoot and the undesired vibration of the suction piston.

It is true that the transmission of the pressure from the vacuum chamber 30 to the damper chamber 38 can be made also by the groove configuration between the peripheral surface of the flange 33' and the inner preripheral surface of the suction piston 34. However, since the pressure transmission and the delay of the pressure transmission is performed by the orifice A in quite a stable and predictable manner, the stability of response characteristic is never affected by any error in dimension of the groove configuration if any exist.

As has been stated according to the invention, there is provided a variable venturi type carburetor having the following features. The suction piston has a piston rod which makes a sliding contact with the guide rod of the suction chamber, forms a gas damper chamber, and cooperates with the flange of the guide rod end in defining therebetween a pressure transmission delaying passage or means. The compression spring is disposed in the vacuum chamber which is defined in the suction chamber 29 at the opposite side of the flange to the gas damper chamber so as to act on the suction piston which is exposed to the mixing chamber. Consequently, the force applied to the suction piston when the opening of the throttle valve is changed is determined by the difference between the front surface area of the reduced diameter portion of the suction piston confronting the venturi portion and the area of the rear surface of the increased diameter portion of the same suction valve facing the suction chamber. This obviates the necessity of filling the space in the hollow bore of the guide rod defined by the piston rod position with damper oil. In addition, it is possible to obtain three distinct operating characteristics of the suction piston in response to the operation of the throttle valve, i.e. an instantaneous opening movement in response to the throttle opening, no movement and a reverse closing movement. Consequently, it becomes possible to obtain the damper effect and the braking effect without making use of any damper oil, thereby avoiding the overshoot. Further, it is possible to select and design any one of the above response characteristics, so as to, for example, enrich the mixture at the time of abrupt acceleration.

The damping effect is remarkably improved if the pressure transmission delaying means incorporates the orifice. I.e., if the delaying function relies solely upon the annular clearance between the outer peripheral surface of the flange of the guide rod and the inner peripheral surface of the suction piston, these surfaces have to be machined to high precision to have an accurate concentric relationship. However, any dimensional error of these surfaces does not materially affect the damping effect when the pressure transmission delaying means incorporates the orifice.

Additionally, since it is unnecessary to use the damper oil, the aforementioned problems such as variance of the oil viscosity depending on the seasons, detection of oil consumption and repletion of the same and other mechanical adjustments of the carburetor are eliminated. Consequently, the carburetor of the invention is easy to maintain and has a simplified mechanical construction. Further, the carburetor of the invention can be designed in accordance with specific engines by merely changing surface areas and utilization of different orifices.

What is claimed is:

1. A variable venturi carburetor having predictable and stable response characteristics in response to acceleration demands, said carburetor comprising a casing, a venturi portion in said casing, a fuel reservoir means in said casing, fuel metering jet means in said casing adjacent said venturi portion and adapted to meter fuel to said venturi portion in response to the venturi effect therein, said metering jet means being in communication with said fuel reservoir means, an air horn portion in said casing adjacent to and in communication with said venturi portion and adapted to provide air thereto, a mixing chamber portion in said casing adjacent to and in communication with said venturi portion and adapted to receive and mix air and fuel therefrom, a throttle valve positioned in said mixing chamber and adapted for movement between open and closed positions, a suction chamber in said casing in communication with said mixing chamber, guide means in said suction chamber, suction piston means in slidable and airtight contact with said suction chamber means and connected to said fuel metering jet means so as to control the amount of fuel admitted to said venturi portion, spring means normally biasing said suction piston means to decrease the amount of fuel provided by said fuel metering jet means.

piston rod means on said suction piston means and positioned relative to said guide means so as to create a first airtight chamber, a gas damper chamber means between said suction piston means and said guide means, and a pressure transmission delaying means between said suction chamber and said gas damper chamber means, whereby movement of said suction piston means is predictably and accurrately controlled by the dampening caused by the gradual equalization of pressure between said gas damper chamber means and said suction chamber and the dampening caused by the resistance of the air in said first chamber means to movement of said piston rod means.

2. A carburetor as in claim 1 wherein said suction piston means has an increased diameter portion with a given surface area facing said suction chamber and a reduced diameter portion with a given surface area in said venturi portion, whereby, for a given value of the pressure transmission delaying means, the acceleration response characteristics of the carburetor depends on the proportional relationship between the given surface areas.

3. A carburetor as in claim 2 wherein the given surface area of the increased diameter portion is greater than the given surface area of the reduced diameter portion.

4. A carburetor as in claim 2 wherein the given surface area of the increased diameter portion is equal to the given surface area of the reduced diameter portion.

5. A carburetor as in claim 2 wherein the given surface area of the increased diameter portion is less than the given surface area of the reduced diameter portion.

6. A carburetor as in claim 1 wherein the pressure transmission delay means includes interchangable orifice means mounted on said guide means.

7. A carburetor as in claim 1 wherein said guide means is a hollow bore guide rod extending into said suction chamber and having a flange thereon, a portion of said piston rod means telescopingly received within said bore and entrapping air therein to create said first airtight chamber to thereby resist, by dampening, movement of said piston rod portion upon an abrupt opening of said throttle means in response to acceleration demands.

8. A carburetor as in claim 7 wherein said suction piston means has an increased diameter portion with a given surface area facing said suction chamber and a reduced diameter portion with a given surface area in said venturi portion whereby, for a given value of the pressure transmitting delaying means, the acceleration response characteristice of the carburetor depend on the relative size of the two given surface areas.

9. A carburetor as in claim 8 wherein the pressure transmission delaying means including interchangable orifice means mounted on said flange.

10. A carburetor as in claim 8 wherein the suction piston means includes a bore section, said flange being circular positioned to move within said section, said pressure transmission delaying means comprising a predetermined annular clearance between the flange periphery and the bore.

* * * * *